United States Patent [19]

Shimomura et al.

[11] Patent Number: 4,845,071

[45] Date of Patent: Jul. 4, 1989

[54] HEATSENSITIVE RECORDING MATERIAL

[75] Inventors: Akihiro Shimomura; Toshimasa Usami; Seiji Hatakeyama, all of Shizuoka, Japan

[73] Assignee: Fuji Photo Film Co., Ltd., Kanagawa, Japan

[21] Appl. No.: 168,765

[22] Filed: Mar. 16, 1988

[30] Foreign Application Priority Data

Mar. 16, 1987 [JP] Japan ..... 62-60646

[51] Int. Cl.[4] ..... B41M 5/18

[52] U.S. Cl. ..... 503/205; 427/150; 427/151; 428/195; 428/321.5; 428/913; 503/206; 503/213

[58] Field of Search ..... 503/205, 206, 215, 213, 503/216, 225; 427/150–152; 428/195, 321.5, 913, 914

[56] References Cited

U.S. PATENT DOCUMENTS 4,760,048 7/1988 Kurihara et al. ..... 503/205

*Primary Examiner*—Bruce H. Hess

*Attorney, Agent, or Firm*—Sughrue, Mion, Zinn, Macpeak and Seas

[57] ABSTRACT

A negative type heatsensitive recording material which can realize high contrast image suitable to overhead projector, comprising on a support a heatsensitive layer prepared by coating a composition containing an emulsified dispersion, which is obtained by dissolving a colorless or light colored electron donating dye precursor and a color developer in an organic solvent slightly soluble or insoluble in water then subjecting the resulting solution to an emulsifying dispersion treatment, and decolorizercontaining microcapsules.

4 Claims, No Drawings

HEATSENSITIVE RECORDING MATERIAL

FIELD OF THE INVENTION

The present invention relates to a heatsensitive recording material useful as an image-forming film sheet for overhead projector use.

BACKGROUND OF THE INVENTION

As for the conventional film sheets for overhead projector use, film sheets obtained by the heatsensitive manifold process utilizing heatreactive substances were formerly employed, while in recent years those obtained by thermally deforming a film itself or a resin layer coated on a film, those obtained by making colored powders adhere strongly to a transparent support according to xerography, those formed with a facsimile printer (of the ink sheet-utilizing heatsensitive transfer type), and so on have been employed.

However these films could not be used for heatsensitive recording material which enables images for an overhead projector to be directly transmitted therefrom and received thereon by use of, e.g., a facsimile printer, which becomes popular at present, connected to telephone network; can provide a bright, highly contrasty image with dark background on the screen; can cause very lessened fatigue in eyes when images projected on the screen are watched for a long time; and can produce a sheet for overhead projector use, the contents of which can be easily checked by naked eyes.

SUMMARY OF THE INVENTION

Therefor, the first object of the present invention is to provide a heatsensitive recording material which is suitable for OHP and gives negative type images to decrease fatigue in eyes when the images are projected on a screen.

The second object of the present invention is to provide a heatsensitive recording material which is able to obtain negative type high contrast images by thermal printing heat.

The above-described objects are attained with a heatsensitive recording material obtained by coating on a support a coating composition containing an emulsified dispersion, which is prepared by dissolving a colorless or light colored electron donating dye precursor and a color developer in an organic solvent slightly soluble or insoluble in water, then subjecting the resulting solution to an emulsifying dispersion treatment, and decolorizer-containing microcapsules, and then by drying the coat.

DETAILED DESCRIPTION OF THE INVENTION

The heatsensitive recording material of the present invention takes its color in the unheated area from the reaction product of a colorless or light colored electron donating dye precursor with a color developer, which on the heated area it is decolorized by decolorizer oozing out of microcapsules through their respective thermoresponsive capsule walls. Accordingly, when the recording material is projected with an overhead projector, a picture with the colorless or light colored image and the colored background is thrown on a white screen.

Suitable examples if transparent film support which can be used include polyester, acryl resin, styrene/acryl copolymer, cellulose acetate and like films. However, the invention is not particularly restricted as to material for the support. When the coating composition is applied to a paper support, on the other hand, negative heatsensitive paper is obtained.

A heatsensitive layer of the heatsensitive material concerned in the present invention is described in detail below.

Electron donating dye precursors to be employed in the present invention are selected properly from known colorless or light colored compounds of the kind which can develop their colors by donating an electron or accepting a proton of an acid or the like. These compounds have such a skeleton as that of lactone, lactam, sultone, spiropyran, ester, amide, etc., as a part of their structures, and these skeletons undergo ring-opening or bond cleavage upon contact with a color developer. Preferred examples of such compounds include triarylmethane compounds, diphenylmethane compounds, xanthene compounds, thiazine compounds, spiropyran compounds and so on.

Color developers to be employed in the present invention, which undergo the color development reaction with electron donating colorless precursors when heated, can be those selected properly from known color developers. For instance, suitable examples of color developers to be combined with leuco dyes include phenol compounds, triphenyl methane compounds, sulfur-contained phenolic compounds, carboxylic acid compounds, sulfon compounds, urea or thiourea compounds, and so on. Details of the color developers are described, e.g., in "Kami Pulp Gijutsu Times," pp. 49–54, and pp. 65–70 (1985). Of such color developers, those having melting points of 50° to 250° C., particularly phenols and organic acids which have melting points of 60° to 200° C. and are hardly soluble in water, are preferred over others. Combined use of two or more of color developers is desirable because of increase in solubility.

Color developers preferred particularly in the present invention are represented by the following general formulae (I) to (V):

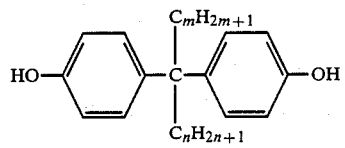

(I)

m = 0–2, n = 2–11

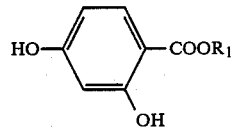

(II)

$R_1$ is an alkyl group, an aryl group, an aryloxy group, or an aralkyl group. In particular, methyl group, ethyl group and butyl group are preferred as $R_1$.

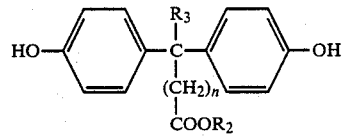

(III)

$R_2$ is an alkyl group. In particular, butyl group, pentyl group, heptyl group, and octyl group are preferred as $R_2$.

$R_3$ is a hydrogen atom or methyl group and n is 0–2.

(IV)

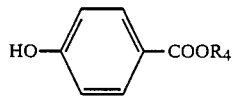

$R_4$ is an alkyl group, an aryloxy group, or an aralkyl group.

(V)

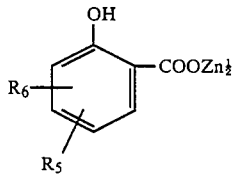

$R_5$ and $R_6$ each represents a hydrogen atom, a halogen atom, a hydroxyl group, a nitro group, an alkyl group, an allyl group, and aralkyl group and an alkylallyl group.

In the above developers, it is possible to add a photodiscoloration inhibitor as described, e.g., in Japanese Patent Application Nos. 125470/85, 125471/85 and 125472/85, if desired.

In the present invention, such a color developer is used in a form of emulsified dispersion. The dispersion can be prepared by dissolving color developers in an organic solvent slightly soluble or insoluble in water, and mixing the resulting solution with an aqueous phase which contains a surface active agent, and a water-soluble high polymer as a protective colloid to emulsify and to disperse the solution in the aqueous phase.

An organic solvent to be used for dissolving the electron donating dye precursors and color developers can be properly selected from generally used oils in a pressure sensitive recording material or esters having high boiling point. In these oils, especially the esters and oils having more than two benzene rings but a number of hetero atom in the oil is less than a certain number are desirable.

Some of desirable oils are esters or compounds represented by the following general formulae (VI) to (VIII), triarylmethanes (such as tritoluylmethane, toluyldiphenyl-methane), terphenyl compounds (such as terphenyl), alkylated diphenyl ethers (such as propyldiphenyl ether), hydrogenated terphenyl compounds (such as hexahydroterphenyl), diphenyl ethers, chlorinated paraffins and so on.

(VI)

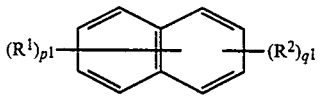

In the above formula, $R^1$ represents a hydrogen atom, or an alkyl group containing 1 to 18 carbon atoms; $R^2$ represents an alkyl group containing 1 to 18 carbon atoms; and $p^1$ and $q^1$ each represents an integer of 1 to 4, provided that the total number of alkyl groups therein is 4 or less. Preferred alkyl groups represented by $R^1$ and $R^2$ are those containing 1 to 18 carbon atoms.

(VII)

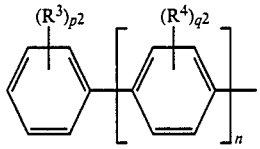

In the above formula, $R^3$ represents a hydrogen atom, or an alkyl group containing 1 to 12 carbon atoms; $R^4$ represents an alkyl group containing 1 to 12 carbon atoms; and n is 1 or 2. $p^2$ and $q^2$ each represents an integer of 1 to 4. The total number of alkyl groups is 4 or less in case of n=1, while it is 6 or less in case of n=2.

(VIII)

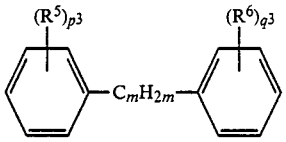

In the above formula, $R^5$ and $R^6$, which may be the same or different, each represents a hydrogen atom, or an alkyl group containing 1 to 18 carbon atoms. m represents an integer of 1 to 13. $p^3$ and $q^3$ each represents an integer of 1 to 3, provided that the total number of alkyl groups is 3 or less.

Of alkyl groups represented by $R^5$ and $R^6$, those containing 2 to 4 carbon atoms are particularly preferred.

Specific examples of the compounds represented by the formula (VI) include dimethylnaphthalene, diethylnaphthalene, diisopropylnaphthalene, and the like.

Specific examples of the compounds represented by the formula (VII) include dimethylbiphenyl, diethylbiphenyl, diisopropylbiphenyl, diisobutylbiphenyl, and the like.

Specific examples of the compounds represented by the formula (VIII) include 1-methyl-1-dimethylphenyl-1-phenylmethane, 1-ethyl-1-dimethylphenyl-1-phenylmethane, 1-propyl-1-dimethylphenyl-1-phenylmethane, and the like.

Specific examples of esters include phosphates (e.g., triphenyl phosphate, tricresyl phosphate, butyl phosphate, octyl phosphate, cresyl-bi-phenyl phosphate), phthalates (e.g., dibutyl phthalate, 2-ethylhexyl phthalate, ethyl phthalate, octyl phthalate, buthlbenzyl phthalate, tetrahydro dioctyl phthalate, benzoates (e.g., ethyl benzoate, propyl benzoate, butyl benzoate, isopentyl benzoate, benzyl benzoate), abietates (e.g., ethyl abietate, benzyl abietate), dioctyl adipate, diethyl succinate, isodecyl succinate, dioctyl azelate, oxalates (e.g, dibutyl oxalate, dipentyl oxalate), diethyl malonate, maleates (e.g., dimethyl maleate, diethyl maleate, dibutyl maleate), tributyl citrate, sorbic esters (methyl sorbate, ethyl sorbate, butyl sorbate), sebacic esters (dibutyl sebacate, dioctyl sebacate), ethyleneglycol esters (e.g., formic acid monoesters and diesters, butyric acid monoesters and diesters, lauric acid monoesters and diesters, palmitic acid monoesters and diesters, stearic acid monoesters and diesters, oleic acid monoesters and diesters), triacetin, diethylcarbonate, diphenylcarbonate, ethylenecarbonate, propylenecarbonate, boric acid esters (e.g, tributyl borate, tripentyl borate). Of these esters, it is particularly preferred to use tricresyl phosphate from the standpoint of stabilization of emulsified dispersion of the color developers.

The above-cited oils can be used as a mixture of two or more thereof, or in combination with other oils.

Further, auxiliary solvents, which have low boiling points and act as dissolution aid, can be added to the foregoing organic solvents in the present invention. Some of these organic solvents are ethyl acetate, isopropyl acetate, butyl acetate, methylene chloride, and the like.

Water soluble high polymers to be contained as a protective colloid in an aqueous phase, which is to be mixed with an oily phase wherein electron donating dye precursors and color developers are dissolved, can be selected properly from known anionic, nonionic or amphoteric high polymers. Of these high polymers, polyvinylalcohol, gelatin, cellulose derivatives and the like are preferred.

Surface active agents to be contained additionally in the aqueous phase can be selected properly from anionic or nonionic surface active agents of the kind which do not cause any precipitation or condensation by interaction with the above-described protective colloids. As examples of surface active agents which can be preferably used, mention may be made of sodium alkylbenzenesulfonates (such as sodium dodecylbenzenesulfonate), sodium alkyl sulfates (such as sodium lauryl sulfate), sodium dioctylsulfosuccinates, polyalkylene glycols (such as polyoxyethylene nonylphenyl ether) and so on.

An emulsified dispersion of electron donating dye precursors and color developers to be used in the present invention can be prepared with ease by mixing an oil phase containing the electron donating dye precursors and the color developer and an aqueous phase containing a protective colloid and a surface active agent with a general means for preparing a fine grain emulsion, such as a high-speed stirrer, an ultrasonic disperser or so on, to disperse the former phase into the latter phase.

To the emulsified dispersion thus obtained, melting point depressants for the color developers can be added, if desired. Some of these melting point depressants have such a function as to control glass transition points of the capsule walls described hereinbefore, too. Specific examples of such melting point depressants include hydroxy compounds, carbamate compounds, sulfonamide compounds, aromatic methoxy compounds and so on. Details of these compounds are described in Japanese Patent Application No. 244190/84.

These melting point depressants can be used in an amount of 0.1 to 2 parts by weight, preferably 0.5 to 1 part by weight, per 1 part by weight of color developer whose melting point is to be depressed. It is to be desired that the melting point depressant and the color developer, whose melting point can be depressed thereby, should be used in the same place. When they are added to separate places, a preferred addition amount of the melting point depressant is 1 to 3 times of that of the above-described one.

An amount of the color developers to be coated is 0.05–8 g/m$^2$ and that of the electron donating dye precursor is 0.02–4 g/m$^2$.

A decolorizer to be used in the present invention has a decolorizing effect on the colored system caused by a reaction of a basic dye and a color developer. As examples of useful decolorizers in the present invention, mention may be made of:

(a) adducts prepared from bisphenols and alkylene oxides (as described in Japanese Patent Application No. 46689/78);

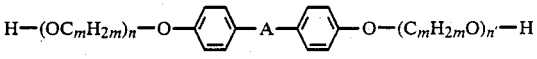

(wherein A represents a methylene or an alkylidene group), (b) methylol amides and bisamides, having a melting point of 110C. or higher (as described in Japanese Patent Application No. 99563/78), (c) long chain 1,2-glycols (as described in Japanese Patent Application No. 99563/78), (d) terephthalic acid/ethylene oxide adduct (described in Japanese Patent Application No. 96666/78), (e) solid alcohols such as stearyl alcohol, tripropyl carbinol, polyethylene glycol, polypropylene glycol, 1,8-octane diol, dimethyl pentaglycerine 1,2,3,4-tetraoxybutane, etc. (as described in Japanese Patent Publication No. 17865/75), (f) polyethers or polyethylene glycol derivatives, such as polyoxydecamethylene, polyoxymethylene, polyethylene oxide, trimethylene oxide polymers, 1,3-dioxolan polymers, polyoxy-ethylene alkylamines, sorbitane monostearate, polyoxyethylene oleyl ether, polyethylene glycol monostearate, polyoxyethylene alkylamides, oxyethylene alkylamines, etc. (as described in Japanese Patent Publication Nos. 17867/75 and 17868/75), (g) acetamide, stearoamide, phthalonitrile, m-nitroaniline and B-naphthylamine (described in Japanese Patent Publication No. 19991/86), (h) guanidine derivatives, such as 1,3-dichlorohexyl-1-2-phenyl-guanidine, 1,3-dicyclohexyl-2-naphthylguanidine, 2,3-dicyclo-hexyl-1-phenylguanidine, 1,2,3-triphenylguanidine, etc. (as described in Japanese Patent Publication No. 29024/76), and (i) amines or quaternary ammonium salts, such as, tribenzyl amine, N,N,N',N'-tetrabenzylethlenediamine, tricyclohexylamine, dioctadecylamine, 2-aminobenzoxazole, dodecyltrimethylammonium chloride, hexadecyltrimethylammonium chloride, etc. (as described in japanese Patent Application (OPI) No. 18048/75 (the term "OPI" as used herein means an "unexamined published application").

The decolorizer is applied in an amount enough to decolorize the color produced from the basic dye, which can be determined experimentally. In general, a preferable amount of the decolorizer used ranges from 0.05 to 8 g/m.

In the present invention, the microencapsulation of such a decolorizer as described above can prevent decolorization from occurring upon production of the heatsensitive material, and at the same time ensure improvements in properties of keeping both the freshness of the heatsensitive material and the record made therein. Moreover, image density attainable at the time of recording can be hightened by making proper choices of a wall material and a preparation process for the microcapsules.

Suitable examples of wall materials for microcapsules include polyurethane, polyurea, polyester, polycarbonate, urea/formaldehyde resin, melamine resin, polystyrene, styrene/methacrylate copolymer, styrene/acrylate copolymer, gelatin, polyvinyl pyrrolidone, polyvinyl alcohol and so on. These macromolecular substances can be used in combination of two or more thereof in the present invention.

Of the above-cited macromolecular substances, polyurethane polyurea, polyamide, polyester, and polycarbonate are preferred in the present invention. In particular, polyurethane and polyurea can bring about good results.

Microcapsules to be employed in the present invention are preferably prepared by emulsifying a core material containing a reactive substance like a decolorizer etc. and then forming a wall of a macromolecular substance around the droplets of the core material to microencapsulate the core material. Therein, reactants to produce a macromolecular substance are added to the inside and/or the outside of the oily droplets. For details of microcapsules which can be preferably employed in the present invention, e.g., for production methods of microcapsules which can be preferably used, descriptions in Japanese Patent Application (OPI) No. 222716/'84 (the term "OPI" as used herein means an "unexamined published application"), and so on can be referred to.

As the one of core materials of the microcapsules, an organic solvent can be added together with the decolorizer. The similar organic solvents used to dissolve the electron donating dye precursors and color developers can be used as the above organic solvents.

In order to keep a transparency of thermally printed part in a high grade, it is desired to make a refractive index of the core material of microcapsule nearly equal to that of oil phase in which the electron donating dye precursor and color developer are dissolved.

A preferred size of microcapsules to be employed in the present invention is 2 microns or less, particularly 1 micron or less, on a volume average basis according to the evaluation method described, e.g., in Japanese Patent Application (OPI) No. 214990/'85.

Desirable microcapsules which are produced in the above-described manner are not those of the kind which are disrupted by heat or pressure, but those of the kind which have a microcapsule wall through which reactive substances present inside and outside the individual microcapsules respectively can permeate at high temperature to react with each other.

The heat sensitive recording material of the present invention can be formed using a coating technique with the aid of an appropriate binder.

As for the binder, water soluble polymers and various kinds of emulsions, such as polyvinyl alcohol, a methyl cellulose, a carboxymethyl cellulose, a hydroxypropyl cellulose, a gum arabic, a gelatin, a polyvinyl pyrrolidone, a casein, a styrene-butadiene latex, an acrylonitrile-butadiene latex, a polyvinyl acetate, a polyacrylate, an ethylene-vinylacetate copolymer emulsion, and so on, can be employed. An amount of the binder used is 0.02 to 5 g per square meter on a solids basis.

The heat sensitive recording material of the present invention is produced by providing a heat sensitive layer on a support, such as paper, a synthetic resin film, etc., coating and drying a coating composition, in which microcapsules enclosing a decolorizer therein an a dispersion containing at least a electron donating dye precursor and color developer in an emulsified condition and contained as main components, and further a binder and other additives are incorporated, according to conventional coating method, such as a bar coating method, a blade coating method, an air knife coating method, a gravure coating method, a roll coating method, a spray coating method, a dip coating method, or so on. A coverage of the heat sensitive layer is controlled to 2.5 to 25 g/m$^2$ on a solid basis.

For the purpose of prevention of sticking to a thermal head and improvement upon writing quality, the heat sensitive recording material of the present invention can contain a pigment such as a silica, barium sulfate, titanium oxide, aluminium hydroxide, zinc oxide, calcium carbonate, etc., and finely powdered styrene beads, ureamelamine resin or so on. In order to maintain the transparency of the heat sensitive layer, it is desirable to provide a protective layer to improve freshness keeping quality and stability of recorded image then adding the above pigments in said protective layer. The details of the protective layer are described, e.g., in the "Kami Pulp Gijutsu Times (1985, Nov.) pages 2–4".

Also, metallic soaps can be used for the purpose of prevention of the sticking phenomenon. A proper amount of these additives used is 0.2 to 7 g per square meter.

In the present invention, a back layer may be employed behind the support in order to improve properties such as curling, antistatic and smoothness. As for components of the back layer it is suitable to use similar ones utilized in the protective layer and antistatic agent.

EXAMPLES

The present invention is illustrated in greater detail by reference to the following examples. However, the invention should not be construed as being limited to these examples.

EXAMPLE 1

Color developers (a), (b), (c) and an electron donating dye precursor (d) represented by the structural formulae illustrated below were added in amounts of 2 g, 1 g, 8 g and 2 g, respectively, to a solvent mixture of 5 g of diethylmaleate and 10 g of ethylacetate. The thus obtained solution of the color developers were mixed with 40 g of a 8% water solution of polyvinyl alcohol, 50 g of water and 0.5 g of sodium dodecylbenzenesulfonate, and emulsified with stirring at 10,000 r.p.m. for 5 minute at ordinary temperature using Ace Homogenizer made by Nippon Seiki k.k. to prepare an emulsified dispersion having a grain size of 0.5 micron.

Color developer (a):

Zinc salt of

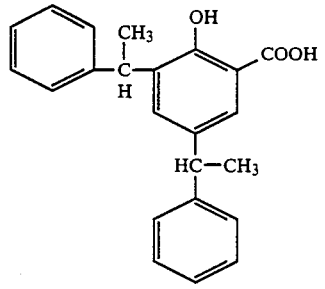

Color developer (b):

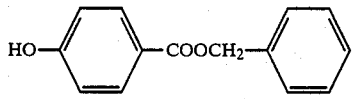

Color developer (c)

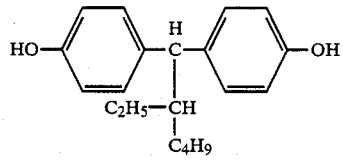

Electron donating dye precursor (d):

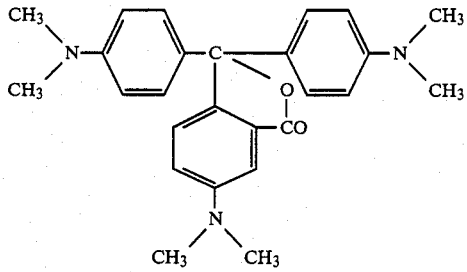

Decolorizer (e),

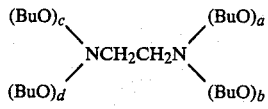

wherein a+b+c+d=12

Preparation of Decolorizer Capsule Solution 10 g of a decolorizer illustrated below, 20 g of 1-phenyl-1-xylylethane, 10 g of ethylacetate and 25 g of Takenate D 110 N (Trade name of capsule wall material, produced by Takeda Yakuhin K.K.) were mixed together. Then the obtained solution was mixed with 60 g of 8 weight % aqueous solution of polyvinylalcohol 217 E and 20 g of water, and emulsified with stirring at 10,000 r.p.m. for 5 minutes using Ace Homogenizer made by Nippon Seiki k.k.. Then the resulting emulsion was diluted with 150 g of water, and allowed to stand at 40° C. for 3 hours to conduct the microencapsulation reaction therein. Thus, a solution containing microcapsules having a size of 0.7 micron was obtained.

Preparation of Heat Sensitive Recording Material

A 5.0 g portion of the foregoing capsule solution, a 10.0 g portion of the foregoing electron donating dye precursor and color developer emulsified dispersion and 5.0 g of water were mixed with stirring, coated on a 70 micron-thick transparent polyethylene terephthalate (PET) film support at a coverage of 15 g/m$^2$ on a solids basis, and dried. Thereon, a 2 micron -thick protective layer having the following composition was further provided to produce a transparent heat sensitive film.

| (Composition of Protective Layer) | |
|---|---|
| Modified Polyvinylalcohol with silicon (PVA R2105: manufactured by Kurare K.K.) | 1 weight part (solid basis) |
| Colloidal silica | 1.5 weight part |

-continued

| (Composition of Protective Layer) | |
|---|---|
| (Snowtex 30: manufactured by Nissan Kagaku K.K.) | (solid basis) |
| Zinc stearate (Hidolin Z-7: manufactured by Chukyo Yushi k.k.) | 0.02 weight part (solid basis) |
| Paraffin wax (Hidolin P-7: manufactured by Chukyo Yushi k.k.) | 0.01 weight part (solid basis) |

COMPARATIVE EXAMPLE

Preparation of a Solution Containing Decolorizer 30 g of the electron donating dye precursor (d) and 30 g of benzil hydroxybenzoate were added to 250 g of aqueous polyvinylalcohol, then raising a temperature of the solution to 96° C. and maintained the temperature for 1 hour under an agitation. The temperature of heat solution was fallen to ordinary temperature then dispersed using ball mill so that an average size of emulsion would become 3 micron.

Preparation of a Solution Containing a Decolorizer

On the otherhand, 30 g of triphenylguanidine was added into 150 g of polyvinylalcohol then dispersed with ball mill so that an average size of emulsion would become 2 micron.

(2) Preparation of a Coating solution for Heat Sensitive Layer and Coating Thereof The following mixture was coated on a 70 micron thick polyethylene telephthalate base at a coverage of 10 g/m$^2$ on a solid basis.

Solution containing coloring agents: 30 g
Solution containing decolorizer: 70 g
50% Styrene butadiene latex: 10 g (3) Preparation of Protective Layer Coating Solution and Coating Thereof Protective layer was provided in the same manner as the Example.

Estimation

On each Sample, thermal recording was carried out using UF-3 (Facsimile manufactured by Matsushita Denso K.K.). The recorded part had changed into transparent and recorded sample can be used for OHP, wherein the sample obtained according to the Example had so improved transparency that the sample obtained according to the Comparative Example that the projected image of the former sample was much better than that of the latter sample.

We claim:

1. A heat-sensitive recording material which comprises on a support a heat-sensitive layer prepared by coating a composition containing an emulsified dispersion, which is obtained by dissolving a colorless or light colored electron donating dye precursor and a color developer in an organic solvent slightly soluble or insoluble in water to cause a color-forming reaction and then subjecting the resulting solution to an emulsifying dispersion treatment, and decolorizer-containing microcapsules.

2. The heat-sensitive recording material as claimed in claim 1, wherein said organic solvent is an ester or mixture of esters.

3. The heat-sensitive recording material as claimed in claim 1, wherein a melting point of said color developer is between 50° C. and 250° C.

4. The heat-sensitive recording material as claimed in claim 3, wherein said color developer is selected from a group consisting of phenols slightly soluble in water and organic acids.

* * * * *